US008604373B2

(12) United States Patent
Dai

(10) Patent No.: US 8,604,373 B2
(45) Date of Patent: Dec. 10, 2013

(54) ELECTRONIC DEVICE WITH POWER BUTTON ASSEMBLY

(75) Inventor: Bin Dai, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 175 days.

(21) Appl. No.: 13/302,101

(22) Filed: Nov. 22, 2011

(65) Prior Publication Data

US 2012/0312674 A1 Dec. 13, 2012

(30) Foreign Application Priority Data

Jun. 7, 2011 (CN) ..... 2011 1 0150085

(51) Int. Cl.
*H01H 13/70* (2006.01)

(52) U.S. Cl.
USPC ..... 200/344

(58) Field of Classification Search
USPC ..... 200/344, 345, 341, 296, 520, 50.02, 200/50.28, 50.14, 50.36, 534, 329–331
See application file for complete search history.

(56) References Cited

U.S. PATENT DOCUMENTS

| | | | | |
|---|---|---|---|---|
| 2011/0094866 | A1* | 4/2011 | Dai | 200/345 |
| 2011/0094867 | A1* | 4/2011 | Dai | 200/345 |
| 2011/0094869 | A1* | 4/2011 | Dai | 200/534 |
| 2011/0114464 | A1* | 5/2011 | Tang | 200/534 |

* cited by examiner

*Primary Examiner* — Edwin A. Leon
*Assistant Examiner* — Harshad Patel
(74) *Attorney, Agent, or Firm* — Altis Law Group, Inc.

(57) ABSTRACT

An electronic device includes a housing and a power button assembly mounted on the housing. The housing defines an assembly hole and an assembly portion around the assembly hole, and the assembly portion includes a side wall. The power button assembly includes a pressing button received in the assembly hole, a printed circuit board, and a support plate connected to the printed circuit board. The support plate is fixed on the housing, such that the printed circuit board is positioned opposite the pressing button. The support plate includes a plurality of positioning portions bent towards the printed circuit board along an imaginary outline corresponding to the side wall, respectively, and the positioning portions are inserted in the assembly portion and abut the side wall correspondingly.

9 Claims, 7 Drawing Sheets

ELECTRONIC DEVICE WITH POWER BUTTON ASSEMBLY

BACKGROUND

1. Technical Field

The present disclosure relates generally to electronic devices, particularly, to an electronic device having a power button assembly.

2. Description of Related Art

An electronic device is provided with a power button assembly to turn a power supply on or off. The power button assembly may be received in an assembly hole defined in a housing of the electronic device. The power button assembly includes a press button and a printed circuit board (PCB), the PCB includes an electric terminal corresponding to the press button. When the press button is pressed to contact the electric terminal, the power supply turns on or off. In assembling the power button assembly to the electronic device, the press button is received in the assembly hole, and the PCB is positioned on one side of the press button by means of a positioning mechanism to ensure assembly accuracy between the PCB and the press button, thereby the press button effectively electronically contacts the PCB. However, the PCB may be incorrectly positioned in relation to the press button due to insufficient accuracy of the positioning mechanism, thus the power button assembly may malfunction or even break down in use.

Therefore, there is room for improvement within the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
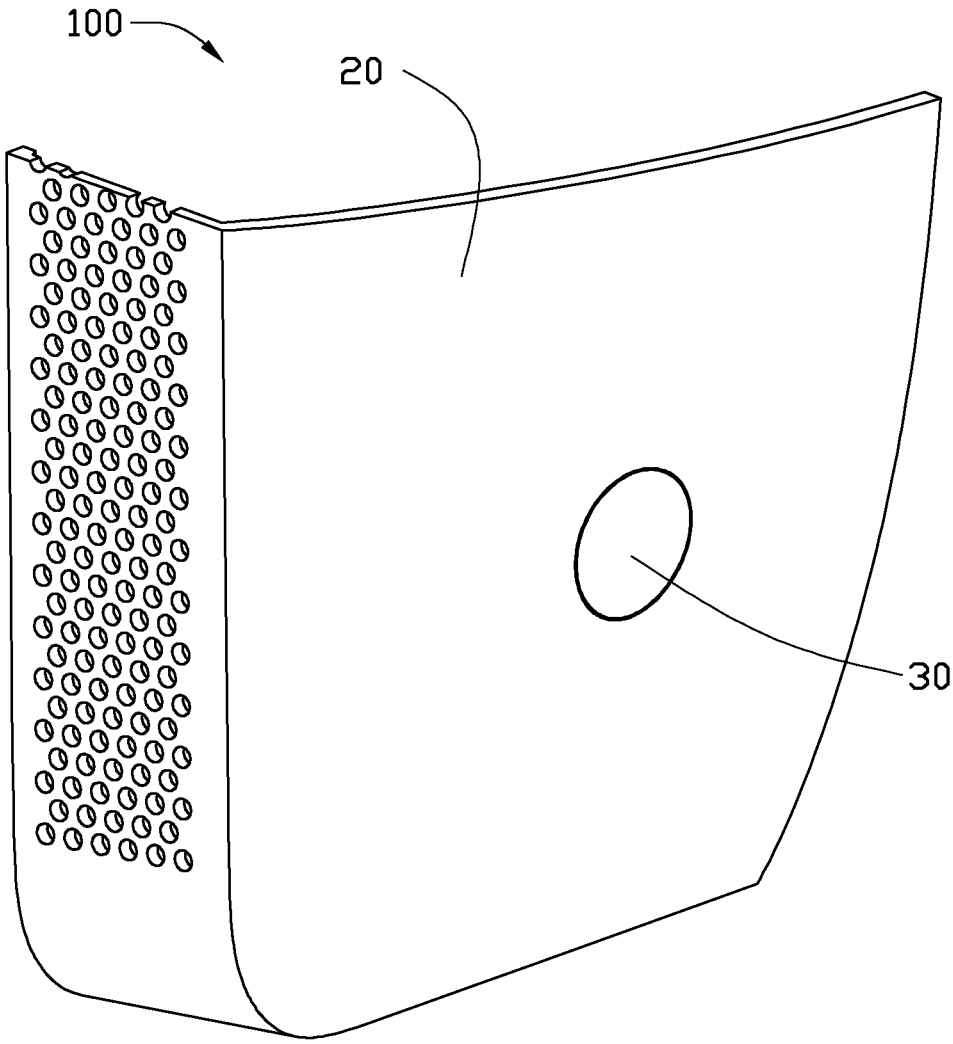
FIG. 1 is a partial, isometric view of one embodiment of an electronic device, in which the electronic device includes a press button and a printed circuit board.
Figure 2:
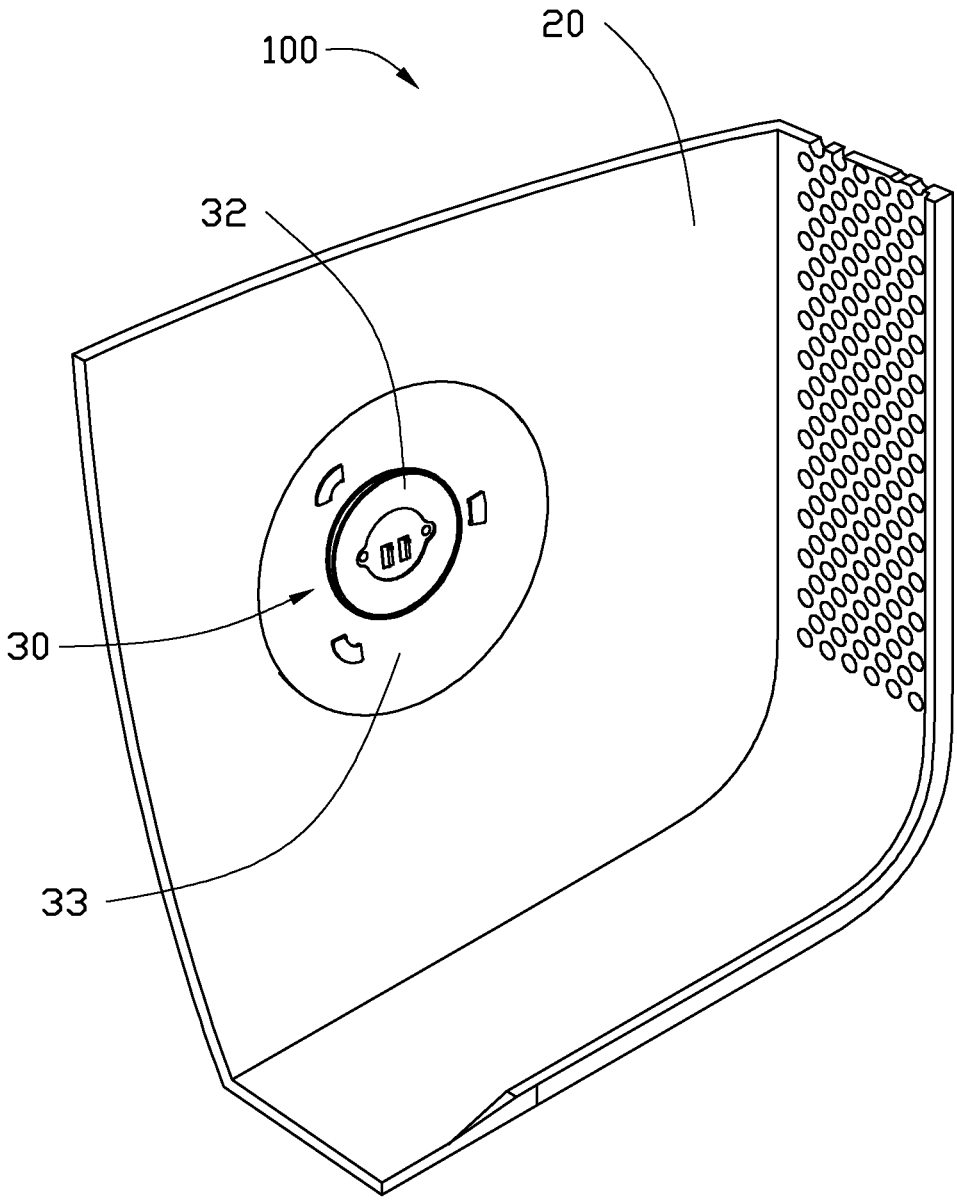
FIG. 2 is similar to FIG. 1, but viewed from another aspect.

Referring to FIGS. 1 and 2, one embodiment of an electronic device 100 includes a housing 20 and a power button assembly 30 mounted on the housing 20. The electronic device 100 may be a notebook, a desktop computer, a liquid crystal display or other electronic device capable of employing the power button assembly 30. The electronic device 100 includes various modules for performing specific functions and features. However, for simplicity, only the module related to the power button assembly 30 is described.

Figure 3:
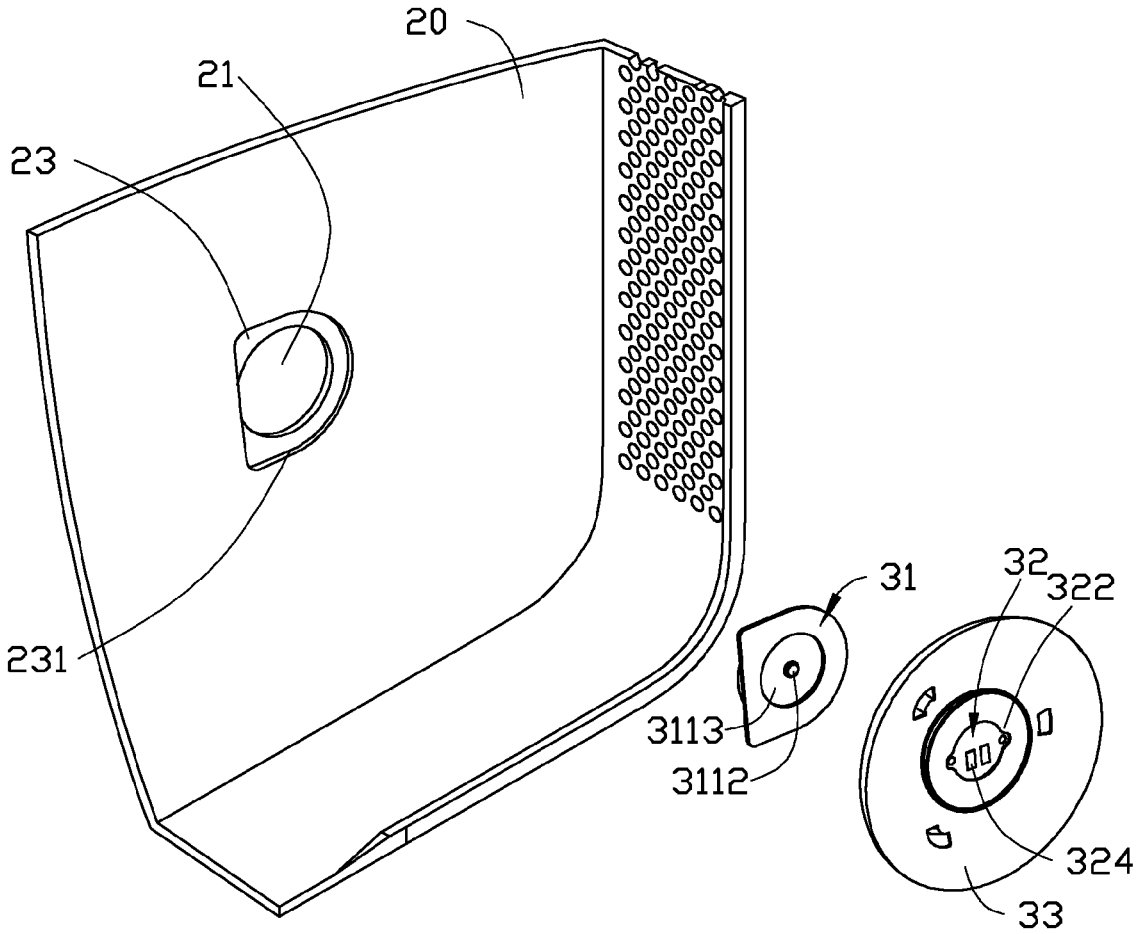
FIG. 3 is an exploded, isometric view of the electronic device of FIG. 2.
Figure 4:
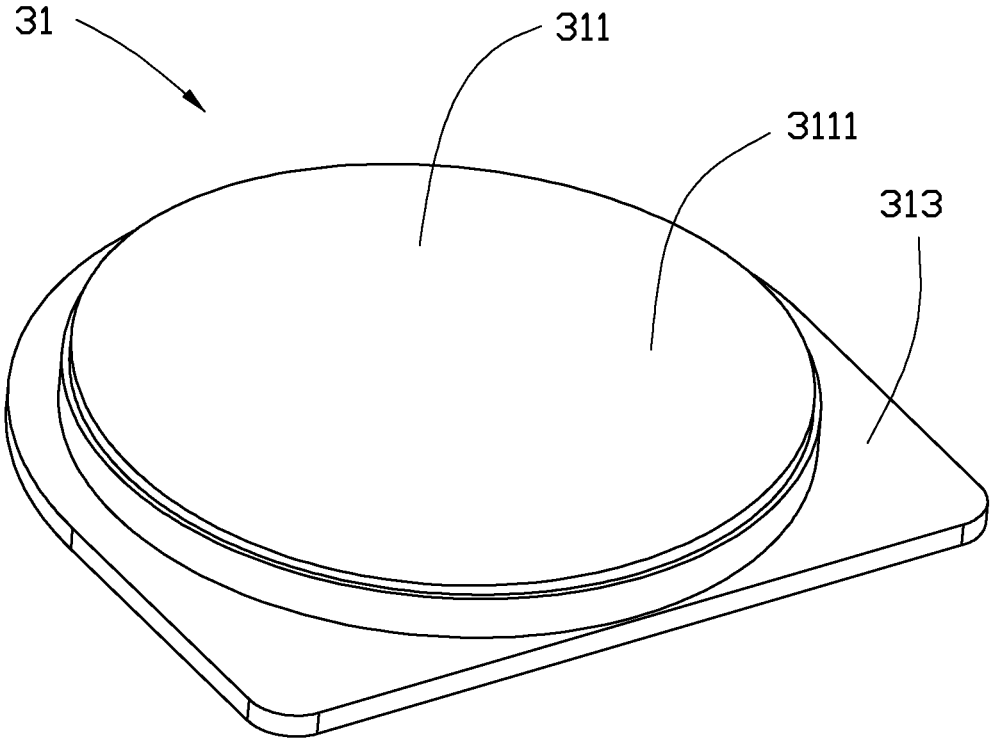
FIG. 4 is an isometric view of the press button of the electronic device of FIG. 2.

Referring to FIGS. 3 and 4, the housing 20 defines an assembly hole 21 and an assembly portion 23 around the assembly hole 21. In the illustrated embodiment, the assembly portion 23 is substantially a U-shaped depression defined in the inner surface of the housing 20 around the assembly hole 21. The assembly portion 23 may be of another shape, such as square or rectangular. The assembly portion 23 includes a side wall 231, and the side wall 231 is also substantially U-shaped in the illustrated embodiment. The power button assembly 30 is mounted on the housing 20 by means of the assembly hole 21.

The power button assembly 30 includes a press button 31, a support plate 33, and a printed circuit board 32 engaging with the support plate 33.

The press button 31 includes a pressing portion 311 and a connecting portion 313 around the pressing portion 311. The pressing portion 311 includes a pressing surface 3111 and an inner surface 3113 opposite to the pressing surface 3111. The pressing portion 311 passes through the assembly hole 21, and the connecting portion 313 acts as a shoulder or flange abutting the assembly portion 23. The inside surface of the connecting portion 313 and the side wall 231 of the assembly portion 23 coordinately define a receiving groove 40 (see FIG. 7). A contact portion 3112 protrudes from the inner surface 3113 towards the printed circuit board 32.

Figure 5:
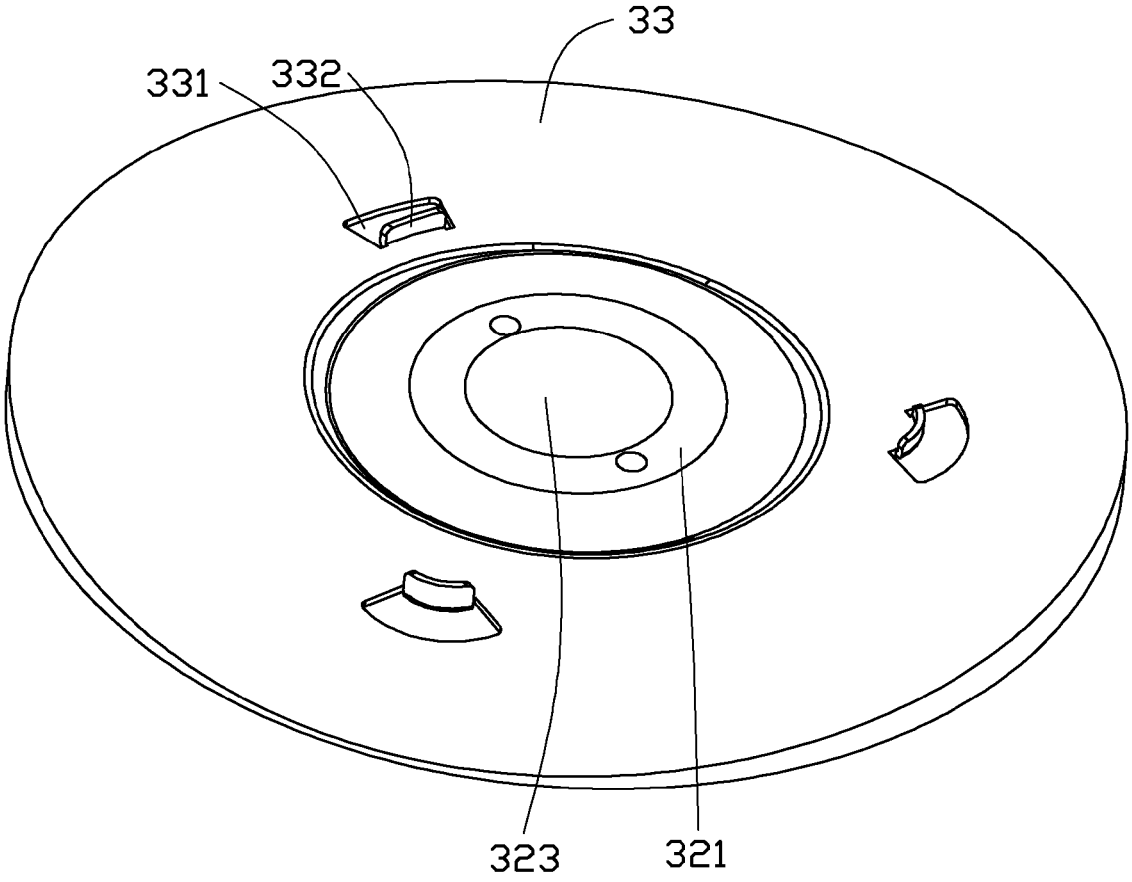
FIG. 5 is an isometric view of the power button assembly of the electronic device of FIG. 2.

Referring to FIG. 5, the printed circuit board 32 includes a first surface 321 and a second surface 322 opposite to the first surface 321. The first surface 321 forms an elastic connecting piece 323. In the illustrated embodiment, the elastic connecting piece 323 is a circular dome. The second surface 322 forms two electric terminals 324 arranged separately and insulated from each other. When the elastic connecting piece 323 is pressed by the contact portion 3112, the elastic connecting piece 323 is deformed to make contact with the two electric terminals 324, and the two electric terminals 324 are then electrically connected to each other. Next, the printed circuit board 32 generates a signal to disconnect a power supply (not shown).

The support plate 33 is a substantially annular metal sheet. The printed circuit board 32 passes through and is fixed to the center of the support plate 33. The support plate 33 defines three through holes 331 along an imaginary U-shaped outline corresponding to the side wall 231, and three positioning portions 332 bent upward from a side of each of the through holes 331, towards the printed circuit board 32. The number of the through holes 331 and thus the number of the positioning portions 332 may be two or more than three.

Figure 6:
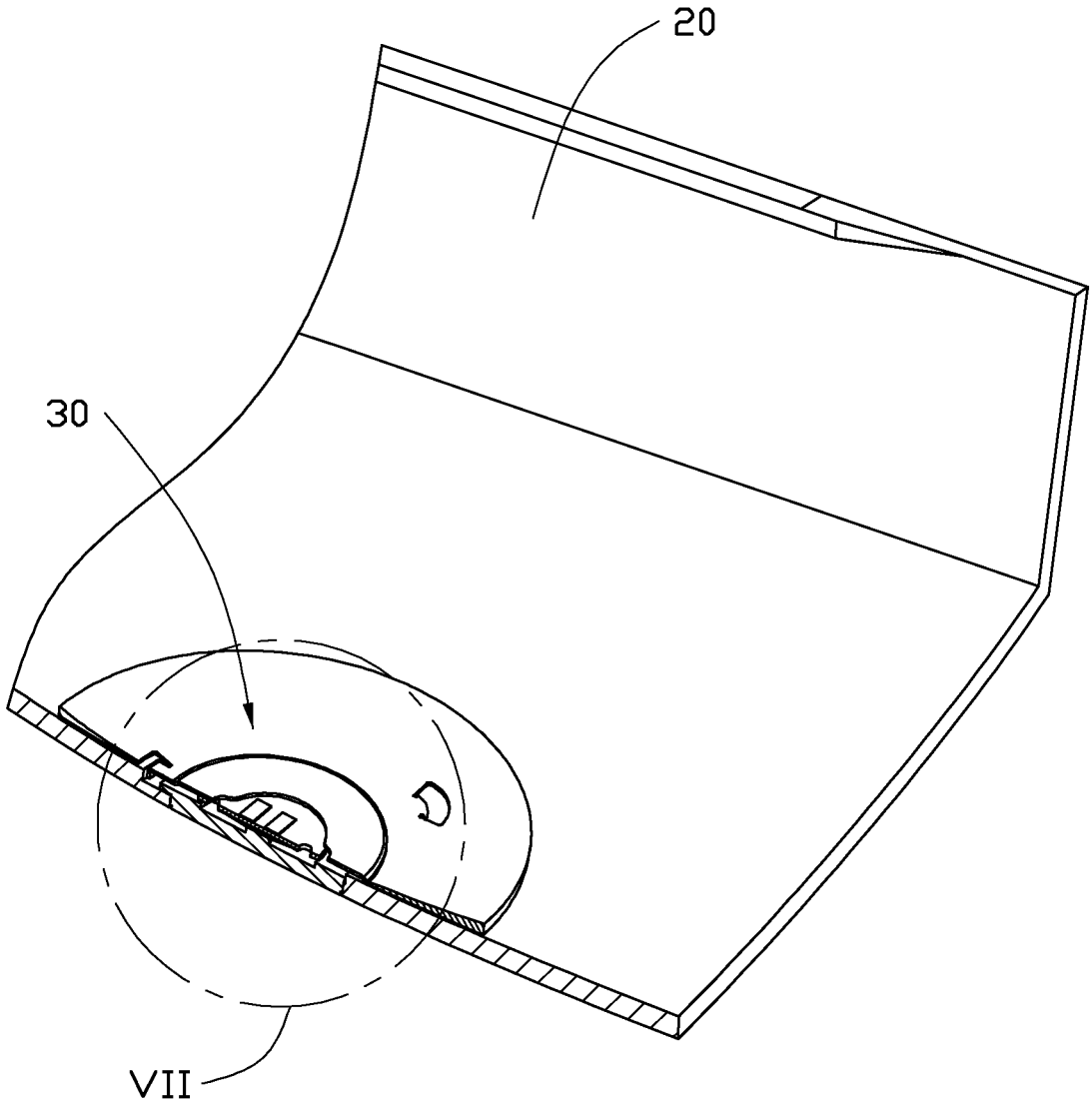
FIG. 6 is a cut-away view of the electronic device of FIG. 2.
Figure 7:
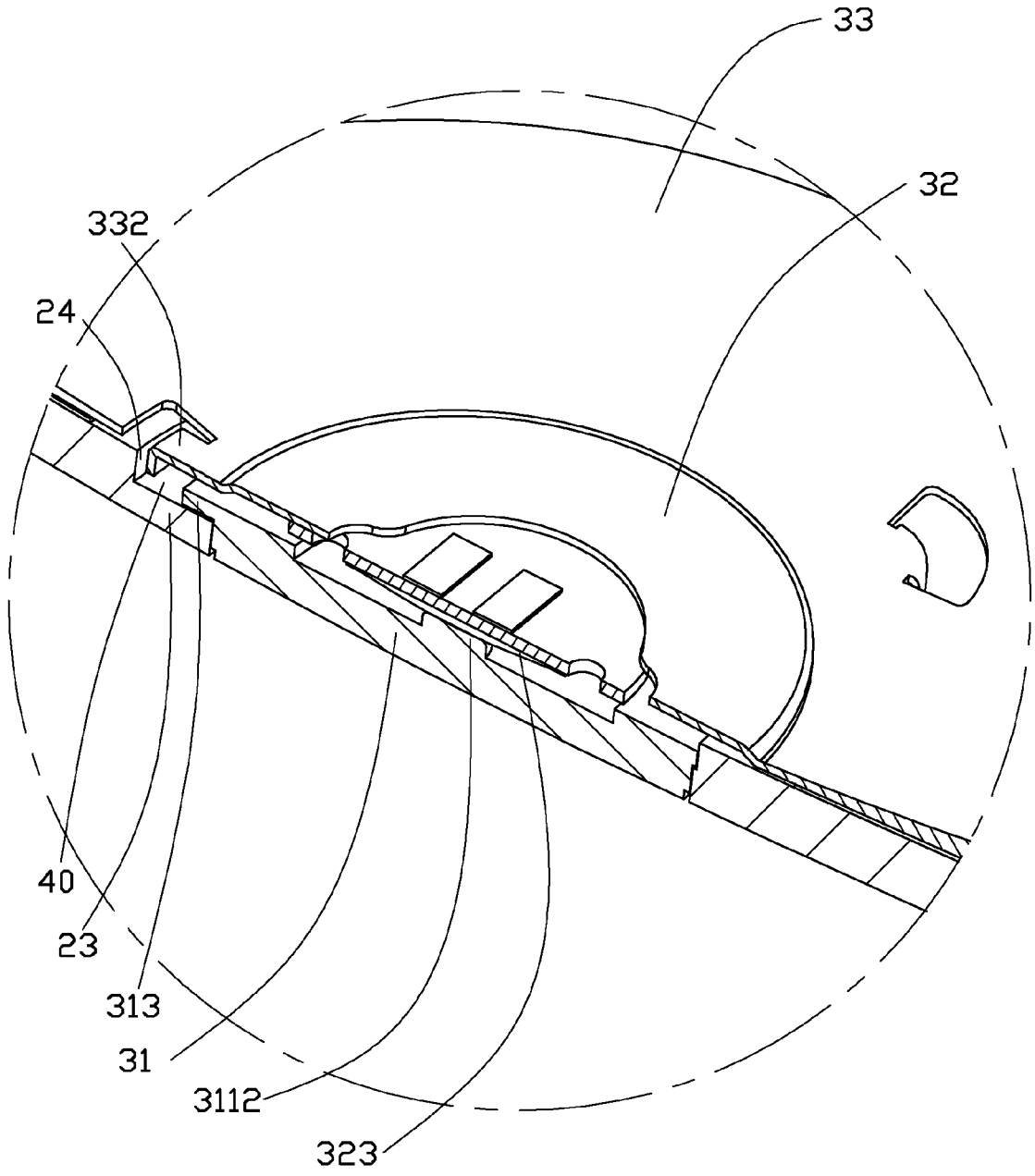
FIG. 7 is an enlarged view of the circled portion VII of FIG. 6.

Referring to FIGS. 6 and 7, in assembling of the power button assembly 30 to the housing 20, the press button 31 is positioned in the assembly portion 23 with the pressing portion 311 extending through the assembly hole 21 and the connecting portion 313 abutting the assembly portion 23. As a result, the receiving groove 40 is formed, and the positioning portions 332 are received in the receiving groove 40, and abut the side wall 231 to prevent any lateral movement of the support plate 33. Thus, the elastic connecting piece 323 of the printed circuit board 32 is correctly positioned in relation to the contact portion 3112 of the press button 31. The support plate 33 may be fixed to the housing 20 by adhesive or other means.

When a human finger presses the press button 31, the contact portion 3112 presses the elastic connecting piece 323 until the elastic connecting piece 323 makes contact with the two electric terminals 324, to turn on or off the power supply, according to the setup of the electronic device. When the pressing of the elastic connecting piece 323 is released, the compressed elastic connecting piece 323 drives the press button 31 back to its original position.

In the assembly of the power button assembly 30 to the housing 20, it is unnecessary to provide a further positioning mechanism to ensure accuracy in assembling the printed circuit board 32 and the press button 31 together, because the printed circuit board 32 is fixed to the support plate 33, and the support plate 33 is accurately fixed on the housing 20 by virtue of the positioning portions 332 being received in the receiving groove 40 and abutting the side wall 231.

It is believed that the present embodiments and their advantages will be understood from the foregoing description, and it will be apparent that various changes may be made thereto without departing from the spirit and scope of the disclosure or sacrificing all of its material advantages.

What is claimed is:

1. An electronic device, comprising:

a housing defining an assembly hole and an assembly portion around the assembly hole, the assembly portion comprising a side wall; and a power button assembly mounted on the housing, the power button assembly comprising:

a press button received in the assembly hole;

a printed circuit board;

a support plate engageably connected to the print circuit board and fixed to the housing, such that the printed circuit board is positioned opposite to the press button;

wherein the support plate defines a plurality of positioning portions each bent towards the printed circuit board along an imaginary outline corresponding to the side wall, and the positioning portions are inserted in the assembly portion and abut the side wall correspondingly.

2. The electronic device of claim 1, wherein the press button comprises a pressing portion and a connecting portion around the pressing portion, the pressing portion passes through the assembly hole, the connecting portion acts as a shoulder or flange abutting the assembly portion, and a side surface of the connecting portion and the side wall coordinately define a receiving groove to allow the positioning portions to be received in.

3. The electronic device of claim 1, wherein the support plate defines a plurality of through holes along the imaginary outline, and each of the positioning portions is bent upward from a side of each of the through holes.

4. The electronic device of claim 1, wherein the assembly portion is a U-shaped depression defined in an inner surface of the housing.

5. The electronic device of claim 4, wherein the number of the positioning portions is three, the three positioning portions are bent along the imaginary outline corresponding to the side wall, and the imaginary outline is substantially U-shaped.

6. The electronic device of claim 2, wherein the pressing portion comprises a pressing surface, an inner surface opposite to the pressing surface, and a contact portion protruding out from the inner surface towards the printed circuit board.

7. The electronic device of claim 6, wherein the printed circuit board comprises a first surface and a second surface opposite to the first surface, the first surface forms an elastic connecting piece, and the second surface presents two electric terminals arranged separately and insulated from each other; when the elastic connecting piece is pressed to connect the two electric terminals, the electric terminals are then electrically connected to each other.

8. The electronic device of claim 7, wherein the elastic connecting piece is a circular dome.

9. The electronic device of claim 1, wherein the support plate is an annular metal sheet, and the printed circuit board passes through and is fixed to a center of the support plate.

* * * * *